US006945845B2

(12) United States Patent
Bennett et al.

(10) Patent No.: US 6,945,845 B2
(45) Date of Patent: Sep. 20, 2005

(54) CHEMICAL MECHANICAL POLISHING APPARATUS WITH NON-CONDUCTIVE ELEMENTS

(75) Inventors: Doyle E Bennett, Santa Clara, CA (US); Sandeep R Koppikar, San Jose, CA (US); Jeffrey Drue David, San Jose, CA (US); Boguslaw A Swedek, Cupertino, CA (US); Nils Johansson, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 10/643,773

(22) Filed: Aug. 18, 2003

(65) Prior Publication Data

US 2004/0176014 A1 Sep. 9, 2004

Related U.S. Application Data

(60) Provisional application No. 60/452,406, filed on Mar. 4, 2003.

(51) Int. Cl.[7] ..... B24B 49/00; B24B 51/00

(52) U.S. Cl. ..... 451/5; 451/6; 451/9; 451/41

(58) Field of Search ..... 451/5–6, 8–9, 451/11, 285–289; 438/691–693; 324/219, 222, 229–230

(56) References Cited

U.S. PATENT DOCUMENTS

| | | | | |
|---|---|---|---|---|
| 4,005,359 A | | 1/1977 | Smoot | |
| 4,034,265 A | * | 7/1977 | DuRocher et al. | 361/25 |
| 4,112,365 A | | 9/1978 | Larson et al. | |
| 4,303,885 A | | 12/1981 | Davis et al. | |
| 4,467,281 A | | 8/1984 | Davis et al. | |
| 4,500,758 A | * | 2/1985 | Guckenheimer | 200/5 A |
| 4,556,845 A | | 12/1985 | Strope et al. | |
| 4,595,877 A | * | 6/1986 | Dulk | 324/239 |
| 4,673,877 A | | 6/1987 | Sakamoto et al. | |
| 4,715,007 A | | 12/1987 | Fujita et al. | |
| 4,716,366 A | | 12/1987 | Hosoe et al. | |
| 4,829,251 A | | 5/1989 | Fischer | |
| 5,003,262 A | | 3/1991 | Egner et al. | |
| 5,213,655 A | | 5/1993 | Leach et al. | |
| 5,237,271 A | * | 8/1993 | Hedengren | 324/232 |
| 5,336,997 A | * | 8/1994 | Anim-Appiah et al. | 324/207.16 |
| 5,343,146 A | | 8/1994 | Koch et al. | |
| 5,355,083 A | | 10/1994 | George et al. | |
| 5,433,651 A | | 7/1995 | Lustig | |
| 5,537,042 A | * | 7/1996 | Beutler et al. | 324/432 |
| 5,541,510 A | | 7/1996 | Danielson | |
| 5,559,428 A | | 9/1996 | Li et al. | |
| 5,644,221 A | | 7/1997 | Li et al. | |
| 5,660,672 A | | 8/1997 | Li et al. | |
| RE35,703 E | | 12/1997 | Koch et al. | |
| 5,731,697 A | * | 3/1998 | Li et al. | 324/71.5 |
| 5,752,790 A | * | 5/1998 | Szczepanski | 409/2 |
| 5,889,401 A | | 3/1999 | Joudain et al. | |
| 5,893,796 A | | 4/1999 | Birang et al. | |
| 6,068,539 A | | 5/2000 | Bajaj et al. | |
| 6,422,927 B1 | * | 7/2002 | Zuniga | 451/288 |
| 6,564,900 B1 | * | 5/2003 | Dean et al. | 181/202 |
| 2001/0008827 A1 | | 7/2001 | Kimura et al. | |
| 2002/0077031 A1 | * | 6/2002 | Johansson et al. | 451/6 |

FOREIGN PATENT DOCUMENTS

| | | |
|---|---|---|
| EP | 0 460 348 A | 6/1991 |
| EP | 1 116 552 A2 | 7/2001 |

* cited by examiner

*Primary Examiner*—Joseph J. Hail, III
*Assistant Examiner*—Bryan R Muller
(74) *Attorney, Agent, or Firm*—Fish & Richardson

(57) ABSTRACT

Conductive elements of a chemical mechanical polishing system may generate undesired eddy currents under the influence of a time-dependent magnetic field used in an eddy current monitoring system. To improve the accuracy of an eddy current monitoring system, elements that may contribute an undesired signal to the sensed eddy current signal may be fabricated from a non-conductive material such as plastic or ceramic. In some implementations, elements may be fabricated from non-magnetic materials.

16 Claims, 14 Drawing Sheets

CHEMICAL MECHANICAL POLISHING APPARATUS WITH NON-CONDUCTIVE ELEMENTS

REFERENCE TO PRIOR APPLICATION

This application claims the benefit of priority of U.S. Provisional Application Ser. No. 60/452,406, entitled "CHEMICAL MECHANICAL POLISHING APPARATUS WITH NON-CONDUCTIVE ELEMENTS," filed Mar. 4, 2003, which is hereby incorporated by reference.

BACKGROUND

This invention relates to semiconductor manufacturing, and more particularly to endpoint detection.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

One problem in CMP is determining whether the polishing process is complete, i.e., whether a substrate layer has been planarized to a desired flatness or thickness, or when a desired amount of material has been removed. Overpolishing (removing too much) of a conductive layer or film may lead to increased circuit resistance. On the other hand, underpolishing (removing too little) of a conductive layer may lead to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to remove the substrate from the polishing surface and examine it. For example, the substrate can be transferred to a metrology station where the thickness of a substrate layer is measured, e.g., with a profilometer or a resistivity measurement. If the desired specifications are not met, the substrate is reloaded into the CMP apparatus for further processing. This is a time-consuming procedure that reduces the throughput of the CMP apparatus. Alternatively, the examination might reveal that an excessive amount of material has been removed, rendering the substrate unusable.

More recently, in-situ monitoring of the substrate has been performed, e.g., with optical or capacitance sensors, in order to detect the polishing endpoint. Other proposed endpoint detection techniques have involved measurements of friction, motor current, slurry chemistry, acoustics and conductivity. One detection technique that has been considered is to induce an eddy current in the metal layer and measure the change in the eddy current as the metal layer is removed.

SUMMARY

In general, in one aspect a carrier head may include a non-conductive substrate backing assembly, which may include a flexible membrane and one or more clamp rings. The carrier head may include a base assembly, where some components of the base assembly may be non-conductive. The carrier head may include a housing, which may include non-conductive elements. Portions of the carrier head within a sensing distance of the substrate mounting surface may be non-conductive. The sensing distance may be between about one tenth of an inch and about two inches, depending on a number of factors.

The non-conductive elements of the carrier head may also be non-magnetic. That is, they may have a relatively small magnetic permeability and a relatively large resistivity. In some implementations, some elements may be conductive but non-magnetic. For example, non-magnetic fasteners such as aluminum fasteners may be used rather than magnetic fasteners such as steel fasteners.

In general, in another aspect, a polishing system may include a polishing pad having a polishing surface, a carrier to hold a substrate against the polishing surface of the polishing pad, and an eddy current monitoring system including an induction coil positioned on a side of the polishing surface opposite the substrate. The induction coil may be to generate a magnetic field through the pad into a sensing region of the system. Components of the polishing system with at least a portion positioned within a sensing distance of the polishing pad in the sensing region may be non-conductive. The sensing distance may be a distance beyond which the eddy current signal from one or more conductive components of the system is not discernible over a noise signal. The sensing distance may be a distance beyond which the eddy current signal from the one or more conductive components of the system in the sensing region is about equal to or less than an error amount corresponding to an acceptable amount of sign inaccuracy.

The details of one or more implementations are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

The current disclosure provides methods and apparatus for improving an eddy current sensing system by providing non-conductive and/or non-magnetic elements in regions where conductive or magnetic elements may affect the eddy current signal.

In a chemical mechanical polishing apparatus with an eddy current monitoring system, changes in a conductive layer on a wafer may be monitored by detecting an amplitude and/or a phase of a received signal. In some implementations, an amplitude signal may be more sensitive to changes in polishing pad thickness (e.g., due to pad wear or swelling) than a phase signal. Because of this effect, detecting a phase signal may provide a more accurate measure of changes in the conductive layer.

However, the phase signal may be more susceptible to the effect of eddy currents generated in regions outside the conductive region of interest. For example, the phase signal may be non-monotonic (i.e., two different conductive layer thicknesses may correspond to the same phase value) due to eddy currents generated in the chemical mechanical polishing system rather than in the conductive region on the wafer.

Therefore, in order to provide an eddy current sensing signal that more accurately reflects the thickness of one or more conductive regions on a wafer being polished, the current application describes a CMP apparatus where those portions of a CMP carrier head that may prevent a suitably accurate measurement of a conductive layer on a wafer are fabricated using non-conductive materials and/or non-magnetic materials (materials with low magnetic permeability). For example, parts of a CMP carrier head that are proximate to a substrate during polishing may be fabricated from non-conductive and/or non-magnetic materials rather than conductive, magnetic materials such as steel.

Reducing extraneous contributions from the sensed eddy current signal is particularly important in emerging systems that use real-time profile control. In real-time profile control, the sensed eddy current signal is used to update polishing parameters in real time. Noise in the eddy current signal may prevent the real-time profile control system from accurately controlling polishing parameters.

Figure 1:
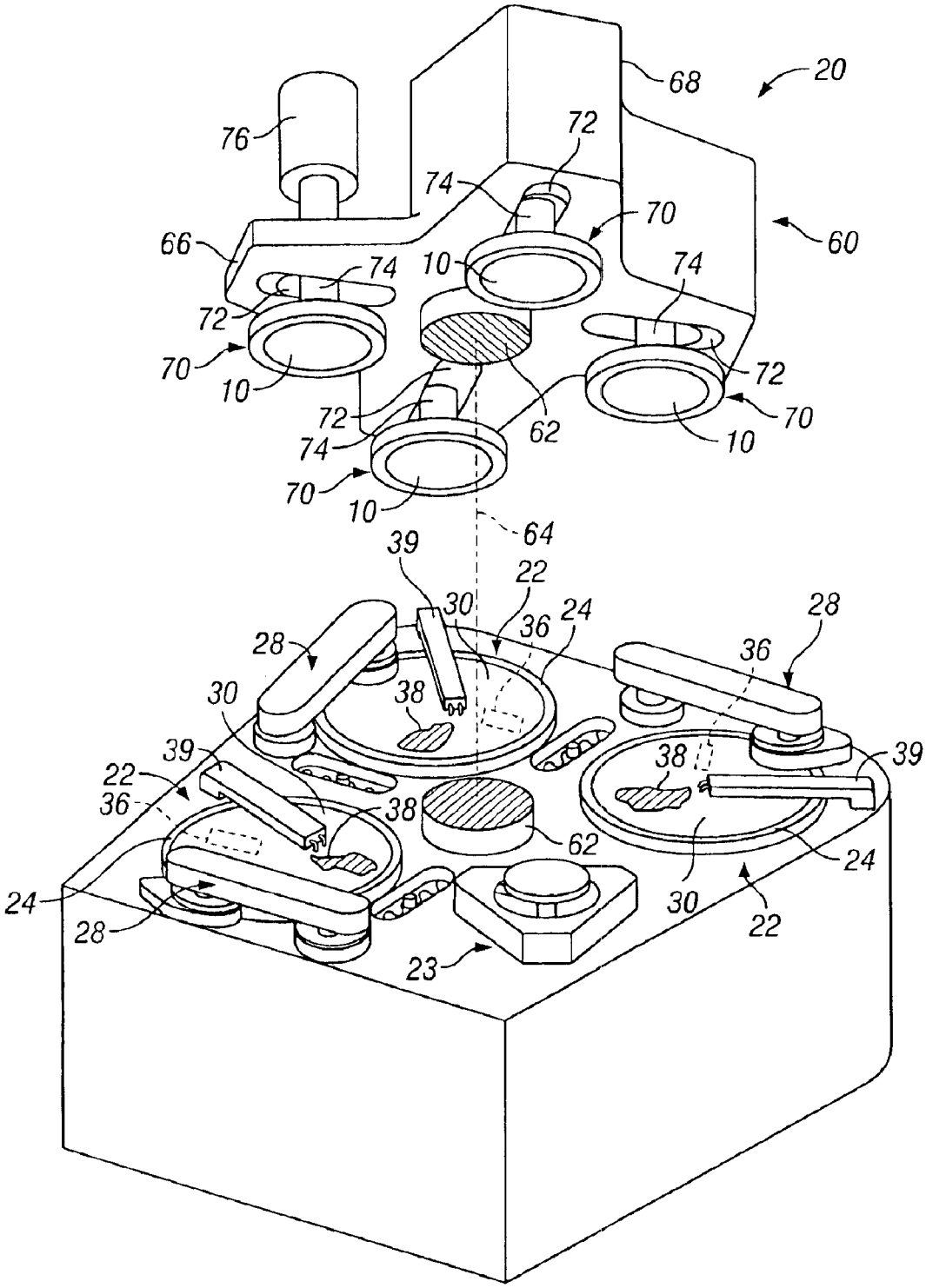
FIG. 1 is a schematic exploded perspective view of a chemical mechanical polishing apparatus.
Figure 2A:
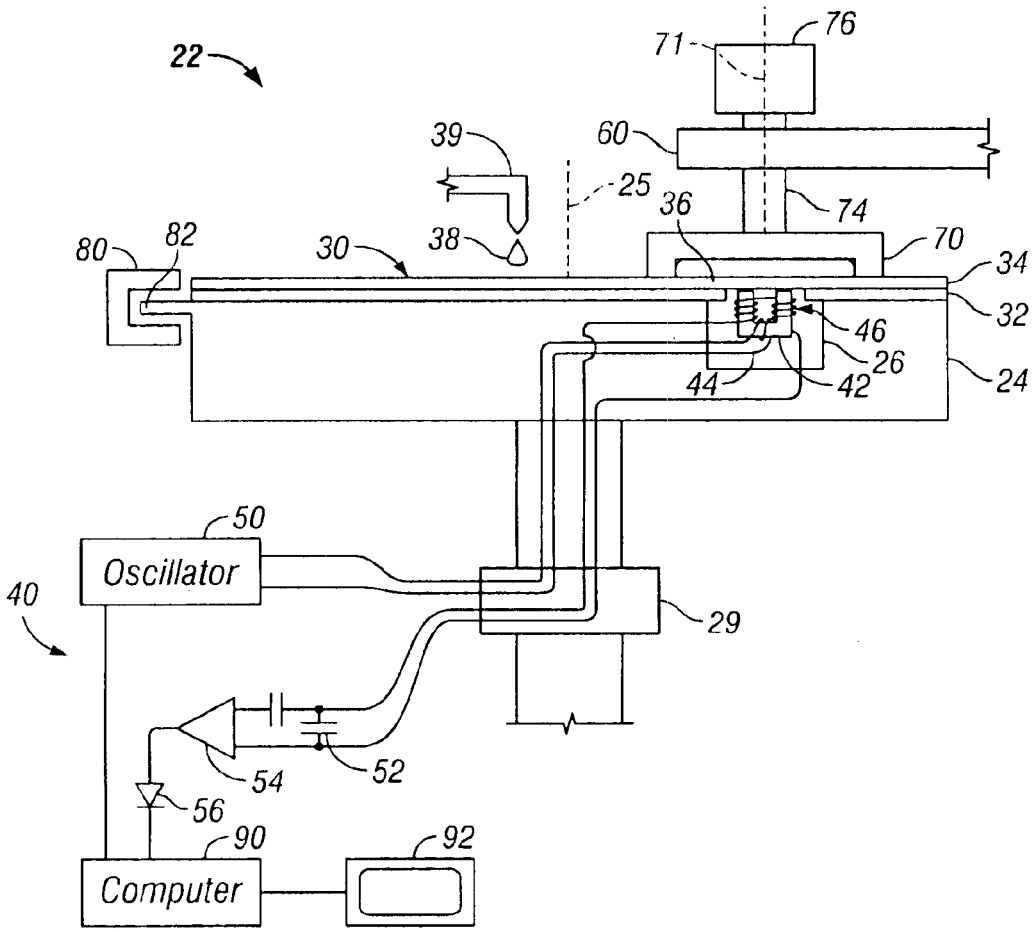
FIG. 2A is a schematic side view, partially cross-sectional, of a chemical mechanical polishing apparatus including an eddy current monitoring system.

Referring to FIGS. 1 and 2A, one or more substrates 10 can be polished by a CMP apparatus 20. A description of a similar polishing apparatus 20 can be found in U.S. Pat. No. 5,738,574, the entire disclosure of which is incorporated herein by reference. Polishing apparatus 20 includes a series of polishing stations 22 and a transfer station 23. Transfer station 23 transfers the substrates between the carrier heads and a loading apparatus.

Each polishing station includes a rotatable platen 24 on which is placed a polishing pad 30. The first and second stations can include a two-layer polishing pad with a hard durable outer surface or a fixed-abrasive pad with embedded abrasive particles. The final polishing station can include a relatively soft pad. Each polishing station can also include a pad conditioner apparatus 28 to maintain the condition of the polishing pad so that it will effectively polish substrates.

A rotatable multi-head carousel 60 supports four carrier heads 70. The carousel is rotated by a central post 62 about a carousel axis 64 by a carousel motor assembly (not shown) to orbit the carrier head systems and the substrates attached thereto between polishing stations 22 and transfer station 23. Three of the carrier head systems receive and hold substrates, and polish them by pressing them against the polishing pads. Meanwhile, one of the carrier head systems receives a substrate from and delivers a substrate to transfer station 23.

Each carrier head 70 is connected by a carrier drive shaft 74 to a carrier head rotation motor 76 (shown by the removal of one quarter of cover 68) so that each carrier head can independently rotate about it own axis. In addition, each carrier head 70 independently laterally oscillates in a radial slot 72 formed in carousel support plate 66. A description of a suitable carrier head 70 can be found in U.S. Pat. No. 6,183,354, filed May 21, 1997, issued Feb. 6, 2001, the entire disclosure of which is incorporated herein by reference. A description of other carrier heads may be found below. In operation, the platen is rotated about its central axis 25, and the carrier head is rotated about its central axis 71 and translated laterally across the surface of the polishing pad.

A slurry 38 containing one or more chemically reactive agents such as catalyzers and oxidizers can be supplied to the surface of polishing pad 30 by a slurry supply port or combined slurry/rinse arm 39. If polishing pad 30 is a standard pad, slurry 38 can also include abrasive particles.

Figure 3:
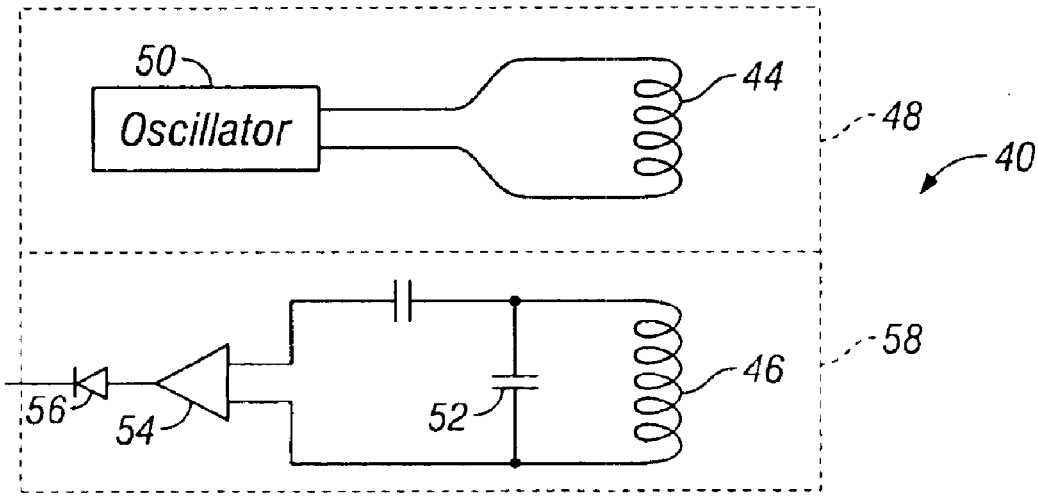
FIG. 3 is a schematic circuit diagram of the eddy current monitoring system.

When a CMP apparatus is removing conductive material from the surface of a substrate, an eddy current monitoring system may be used to monitor changes in one or more conductive regions. Referring to FIGS. 2A and 3, an in-situ eddy current monitoring system may be provided in a chemical mechanical polishing system. A recess 26 is formed in platen 24, and a thin section 36 can be formed in polishing pad 30 overlying recess 26. Aperture 26 and thin pad section 36, if needed, are positioned such that they pass beneath substrate 10 during a portion of the platen's rotation, regardless of the translational position of the carrier head.

Figure 4A:
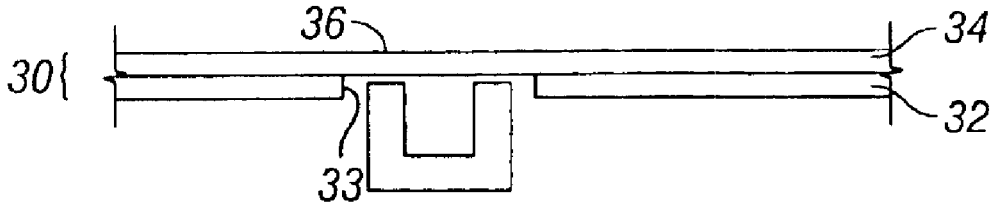
FIGS. 4A–4C are schematic cross-sectional views of a polishing pad.
Figure 4B:
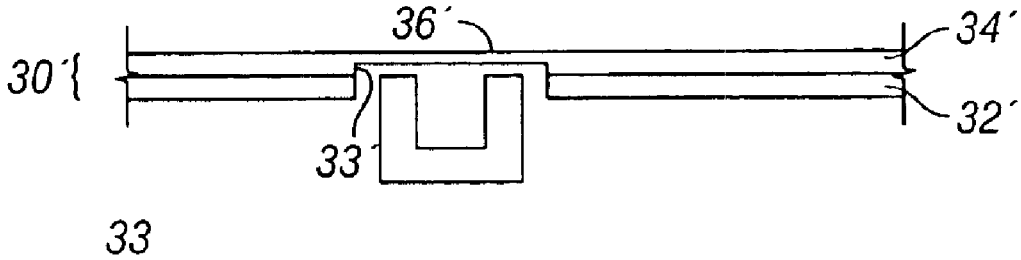
Figure 4C:
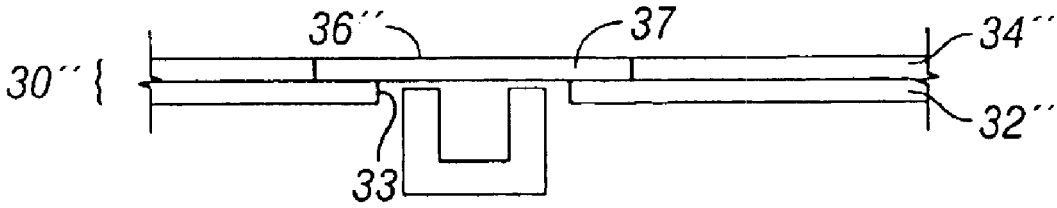

Assuming that polishing pad 32 is a two-layer pad, thin pad section 36 can be constructed as shown in FIG. 4A by removing a portion 33 of backing layer 32. Alternatively, as shown in FIG. 4B, thin pad section 36' can be formed by removing a portion 33' of both backing layer 32' and a portion of cover layer 34'. Thus, this implementation has a recess in the bottom surface of cover layer 34 in the thin pad section 36. If the polishing pad is a single-layer pad, thin pad section 36 can be formed by removing a portion of the pad material to create a recess in the bottom surface of the pad. Alternatively, as shown in FIG. 4C, thin pad section 36" can be formed by inserting a plug 37 of a different material into polishing pad 30. For example, the plug can be a relatively pure polymer or polyurethane, e.g., formed without fillers. In general, the material of pad section 36 should be non-magnetic and non-conductive. If the polishing pad is itself sufficiently thin or has a magnetic permeability (and conductivity) that does not interfere with the eddy current measurements, then the pad does not need any modifications or recesses.

Returning to FIGS. 2A and 3, an in-situ eddy current monitoring system 40, which can function as an endpoint detector, includes a drive system 48 to induce eddy currents in a metal layer on the substrate and a sensing system 58 to detect eddy currents induced in the metal layer by the drive system. The monitoring system 40 includes a core 42 positioned in recess 26 to rotate with the platen, a drive coil 44 wound around one part of core 42, and a sense coil 46 wound around a second part of core 42. For drive system 48, monitoring system 40 includes an oscillator 50 connected to drive coil 44. For sense system 58, monitoring system 40 includes a capacitor 52 connected in parallel with sense coil 46, an RF amplifier 54 connected to sense coil 46, and a diode 56. The oscillator 50, capacitor 52, RF amplifier 54, and diode 56 can be located apart from platen 24, and can be coupled to the components in the platen through a rotary electrical union 29.

Figure 5:
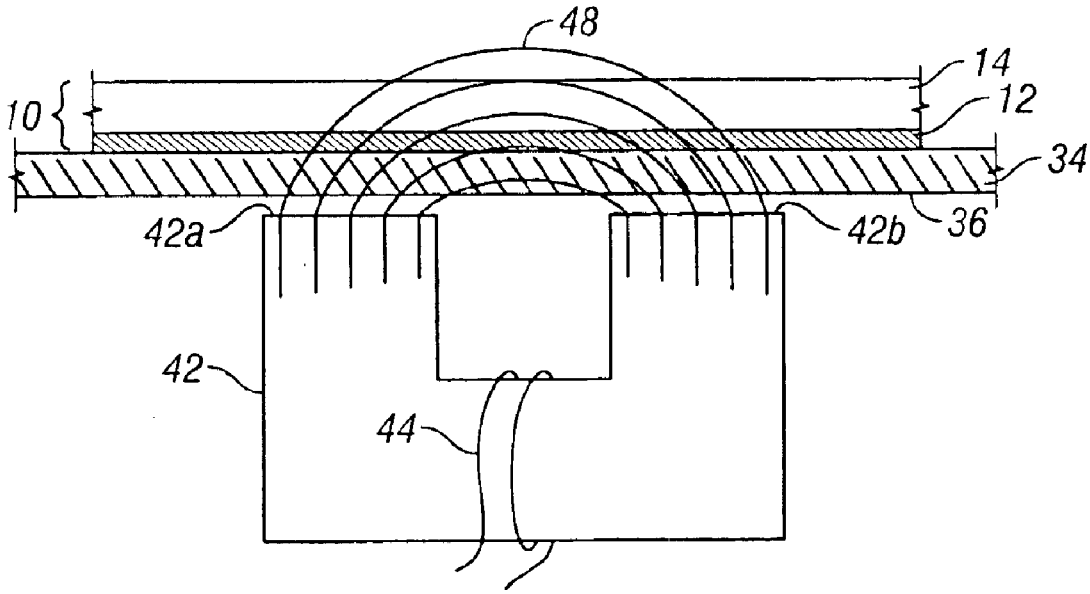
FIG. 5 is a schematic cross-sectional view illustrating a magnetic field generated by the monitoring system.
Figure 6:
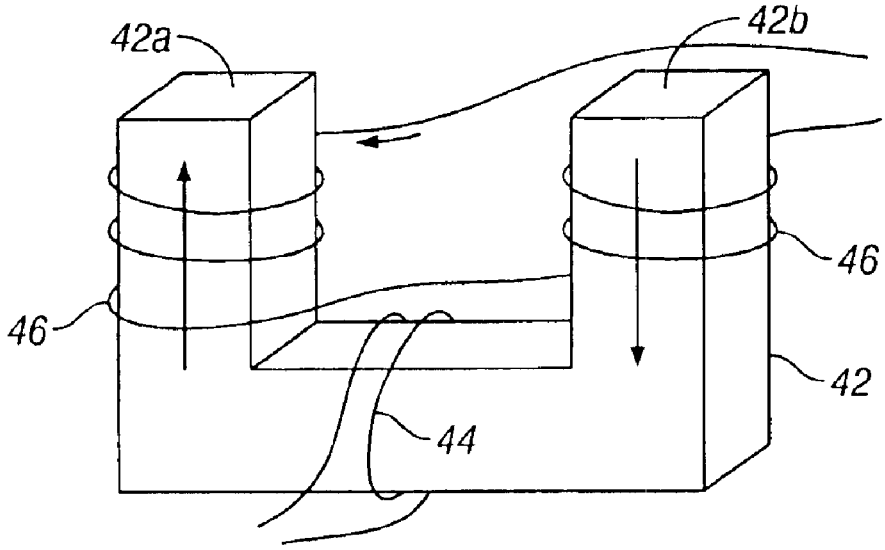
FIG. 6 is a schematic perspective view of a core from an eddy current sensor.

Referring to FIG. 5, in operation the oscillator 50 drives drive coil 44 to generate an oscillating magnetic field 48 that extends through the body of core 42 and into the gap between the two poles 42*a* and 42*b* of the core. At least a portion of magnetic field 48 extends through thin portion 36 of a polishing pad and into substrate 10. If a metal layer 12 is present on substrate 10, oscillating magnetic field 48 generates eddy currents in the metal layer 12. The eddy currents cause the metal layer 12 to act as an impedance source in parallel with sense coil 46 and capacitor 52. As the thickness of the metal layer changes, the impedance changes, resulting in a change in the Q-factor of sensing mechanism. By detecting the change in the Q-factor of the sensing mechanism, the eddy current sensor can sense the change in the strength of the eddy currents, and thus the change in thickness of metal layer 12.

In operation, CMP apparatus 20 uses monitoring system 40 to determine when the bulk of the filler layer has been removed and the underlying stop layer has been exposed. Monitoring system 40 can be used to determine the amount of material removed from the surface of the substrate. A general purpose programmable digital computer 90 can be connected to diode 56 to receive the intensity signal from the eddy current sensing system. Computer 90 can be programmed to sample amplitude measurements from the monitoring system when the substrate generally overlies the core, to store the amplitude measurements, and to apply the endpoint detection logic to the measured signals to detect the polishing endpoint. Possible endpoint criteria for the detector logic include local minima or maxima, changes in slope, threshold values in amplitude or slope, or combinations thereof.

Figure 2B:
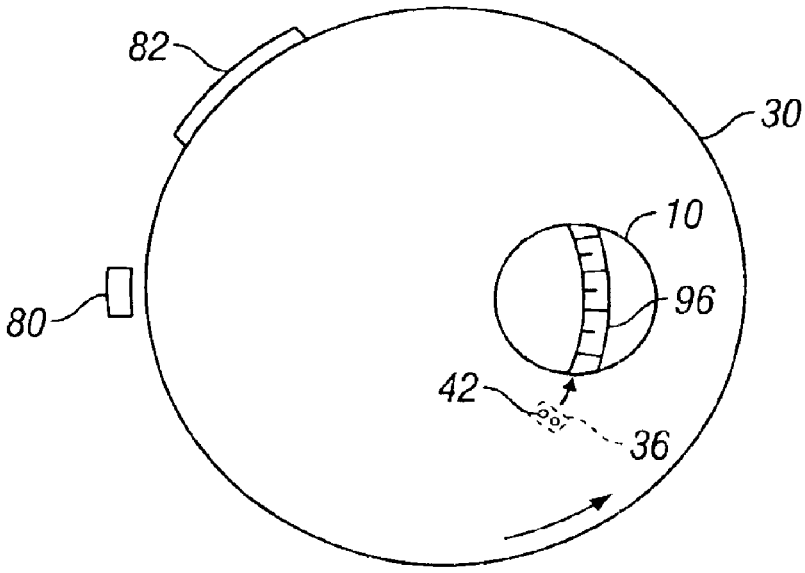
FIG. 2B is a schematic top view of a chemical mechanical polishing apparatus including an eddy current monitoring system, showing a path of a sensor scan across a wafer.

Referring to FIG. 2B, the core 42, drive coil 44 and sense coil 46 of the eddy current sensor located below thin section 36 of polishing pad 32 sweep beneath the substrate with each rotation of the platen. Therefore, the computer 90 can also be programmed to divide the amplitude measurements from each sweep of the core beneath the substrate into a plurality of sampling zones 96, to calculate the radial position of each sampling zone, to sort the amplitude measurements into radial ranges, to determine minimum, maximum and average amplitude measurements for each sampling zone, and to use multiple radial ranges to determine the polishing endpoint, as discussed in U.S. patent application Ser. No. 09/460,529, filed Dec. 13, 1999, the entirety of which is incorporated herein by reference.

Since the eddy current sensor sweeps beneath the substrate with each rotation of the platen, information on the metal layer thickness is being accumulated in-situ and on a continuous real-time basis. In fact, the amplitude or phase (or both) measurements from the eddy current sensor can be displayed on an output device 92 during polishing to permit the operator of the device to visually monitor the progress of the polishing operation.

Moreover, after sorting the amplitude measurements into radial ranges, information on the metal film thickness can be fed in real-time into a closed-loop controller to periodically or continuously modify the polishing pressure profile applied by a carrier head, as discussed in U.S. patent application Ser. No. 60/143,219, filed Jul. 7, 1999, the entirety of which is incorporated herein by reference. For example, the computer could determine that the endpoint criteria have been satisfied for the outer radial ranges but not for the inner radial ranges. This would indicate that the underlying layer has been exposed in an annular outer area but not in an inner area of the substrate. In this case, the computer could reduce the diameter of the area in which pressure is applied so that pressure is applied only to the inner area of the substrate, thereby reducing dishing and erosion on the outer area of the substrate. Alternatively, the computer can halt polishing of the substrate on the first indication that the underlying layer has been exposed anywhere on the substrate, i.e., at first clearing of the metal layer.

Figure 7A:
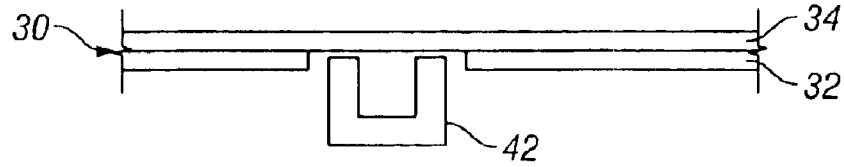
FIGS.7A–7D schematically illustrating a method of detecting a polishing endpoint using an eddy current sensor.

Initially, referring to FIGS. 2A, 3 and 7A, oscillator 50 is tuned to the resonant frequency of the LC circuit, without any substrate present. This resonant frequency results in the maximum amplitude of the output signal from RF amplifier 54.

Figure 7B:
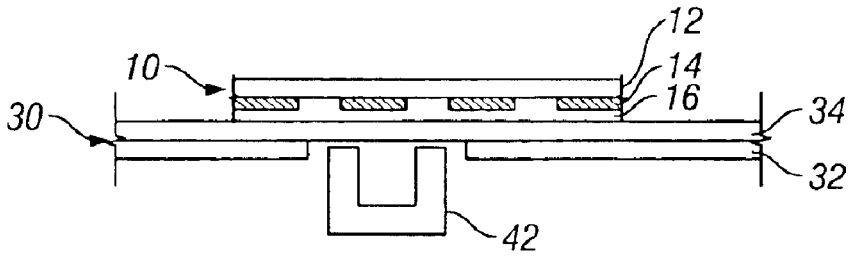
Figure 8:
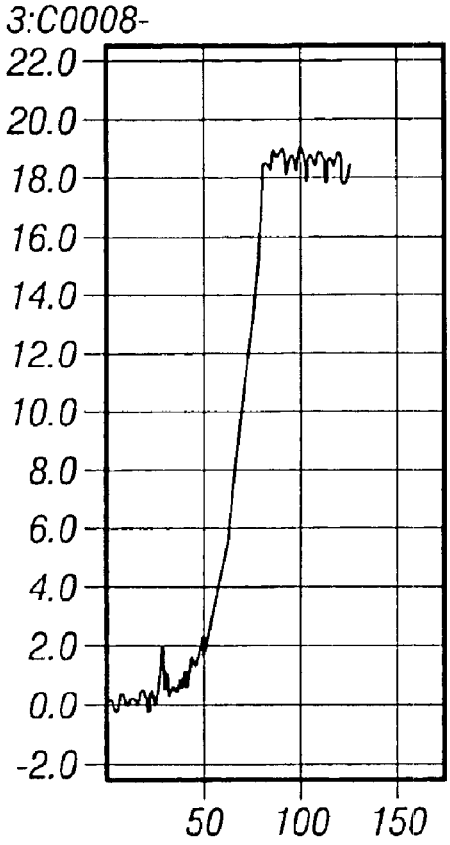
FIG. 8 is a graph illustrating a trace from the eddy current monitoring system.
Figure 9:
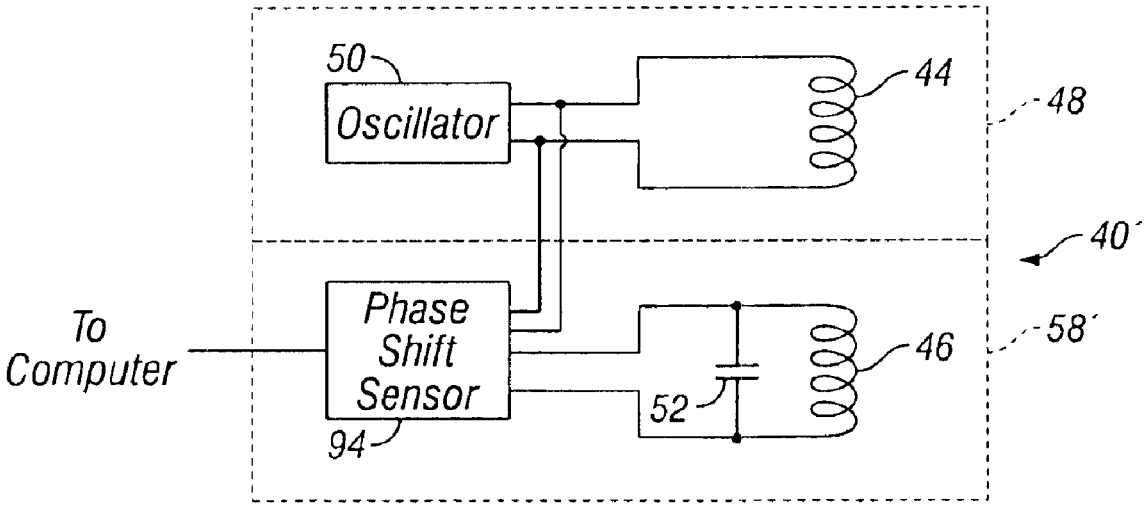
FIG. 9 is a schematic diagrams an eddy current monitoring system that senses a phase shift.

As shown in FIGS. 7B and 8, for a polishing operation, a substrate 10 is placed in contact with polishing pad 30. Substrate 10 can include a silicon wafer 12 and a conductive layer 16, e.g., a metal such as copper, disposed over one or more patterned underlying layers 14, which can be semiconductor, conductor or insulator layers. The patterned underlying layers can include metal features, e.g., vias, pads and interconnects. Since, prior to polishing, the bulk of conductive layer 16 is initially relatively thick and continuous, it has a low resistivity, and relatively strong eddy currents can be generated in the conductive layer. As previously mentioned, the eddy currents cause the metal layer to function as an impedance source in parallel with sense coil 46 and capacitor 52. Consequently, the presence of conductive film 16 reduces the Q-factor of the sensor circuit, thereby significantly reducing the amplitude of the signal from RF amplifier 54.

Figure 7C:
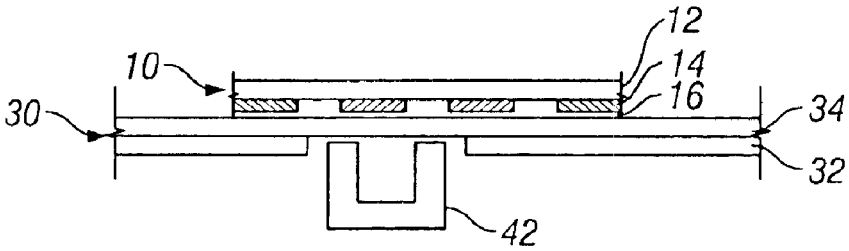

Referring to FIGS. 7C and 8, as substrate 10 is polished, the bulk portion of conductive layer 16 is thinned. As the conductive layer 16 thins, its sheet resistivity increases, and the eddy currents in the metal layer become dampened. Consequently, the coupling between metal layer 16 and sensor circuitry 58 is reduced (i.e., increasing the resistivity of the virtual impedance source). As the coupling declines, the Q-factor of the sensor circuit 58 increases toward its original value.

Figure 7D:
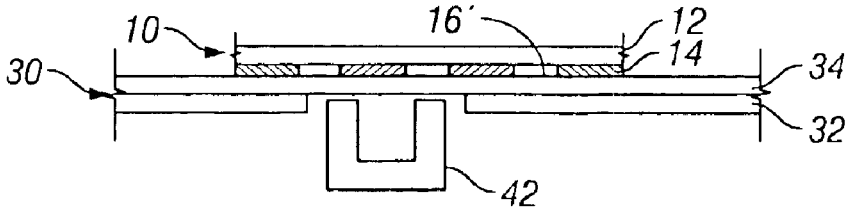

Referring to FIGS. 7D and 8, eventually the bulk portion of conductive layer 16 is removed, leaving conductive interconnects 16' in the trenches between the patterned insulative layer 14. At this point, the coupling between the conductive portions in the substrate, which are generally small and generally non-continuous, and sensor circuit 58 reaches a minimum. Consequently, the Q-factor of the sensor circuit reaches a maximum value (although not as large as the Q-factor when the substrate is entirely absent). This causes the amplitude of the output signal from the sensor circuit to plateau. Thus, by sensing when the amplitude of the output signal is no longer increasing and has leveled off (e.g., reached a local plateau), computer 90 can sense a polishing endpoint. Alternatively, by polishing one or more test substrates, the operator of the polishing machine can determine the amplitude of the output signal as a function of the thickness of the metal layer. Thus, the endpoint detector can halt polishing when a particular thickness of the metal layer remains on the substrate. Specifically, computer 90 can trigger the endpoint when the output signal from the amplifier exceeds a voltage threshold corresponding to the desired thickness.

The eddy current monitoring system can also be used to trigger a change in polishing parameters. For example, when the monitoring system detects a polishing criterion, the CMP apparatus can change the slurry composition (e.g., from a high-selectivity slurry to a low selectivity slurry). As another example, as discussed above, the CMP apparatus can change the pressure profile applied by the carrier head.

In addition to sensing changes in amplitude, the eddy current monitoring system can calculate a phase shift in the sensed signal. As the metal layer is polished, the phase of the sensed signal changes relative to the drive signal from the oscillator 50. This phase difference can be correlated to the thickness of the polished layer. One implementation of a phase measuring device, shown in FIG. 10A, combines the drive and sense signals to generate a phase shift signal with a pulse width or duty cycle which is proportional to the phase difference. In this implementation, two XOR gates 100 and 102 are used to convert sinusoidal signals from the sense coil 46 and oscillator 50, respectively, into square-wave signals. The two square-wave signals are fed into the inputs of a third XOR gate 104. The output of the third XOR gate 104 is a phase shift signal with a pulse width or duty cycle proportional to the phase difference between the two square wave signals. The phase shift signal is filtered by an RC filter 106 to generate a DC-like signal with a voltage proportional to the phase difference. Alternatively, the signals can be fed into a programmable digital logic, e.g., a Complex Programmable Logic Device (CPLD) or Field Programmable Gate Array (FGPA) that performs the phase shift measurements.

Figure 10A:
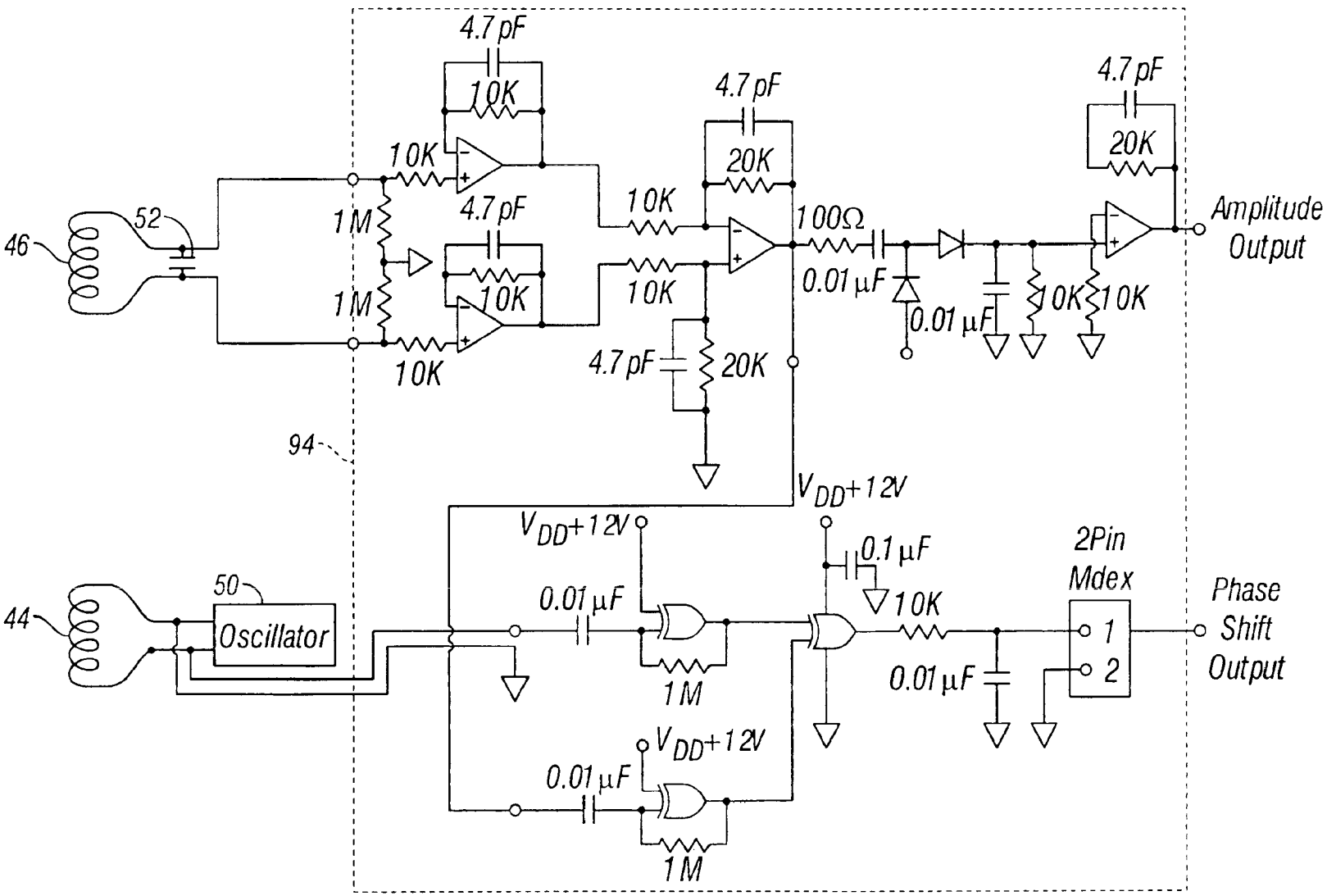
FIGS. 10A and 10B are schematic circuit diagrams of two implementations of an eddy current monitoring system of FIG. 9.
Figure 10B:
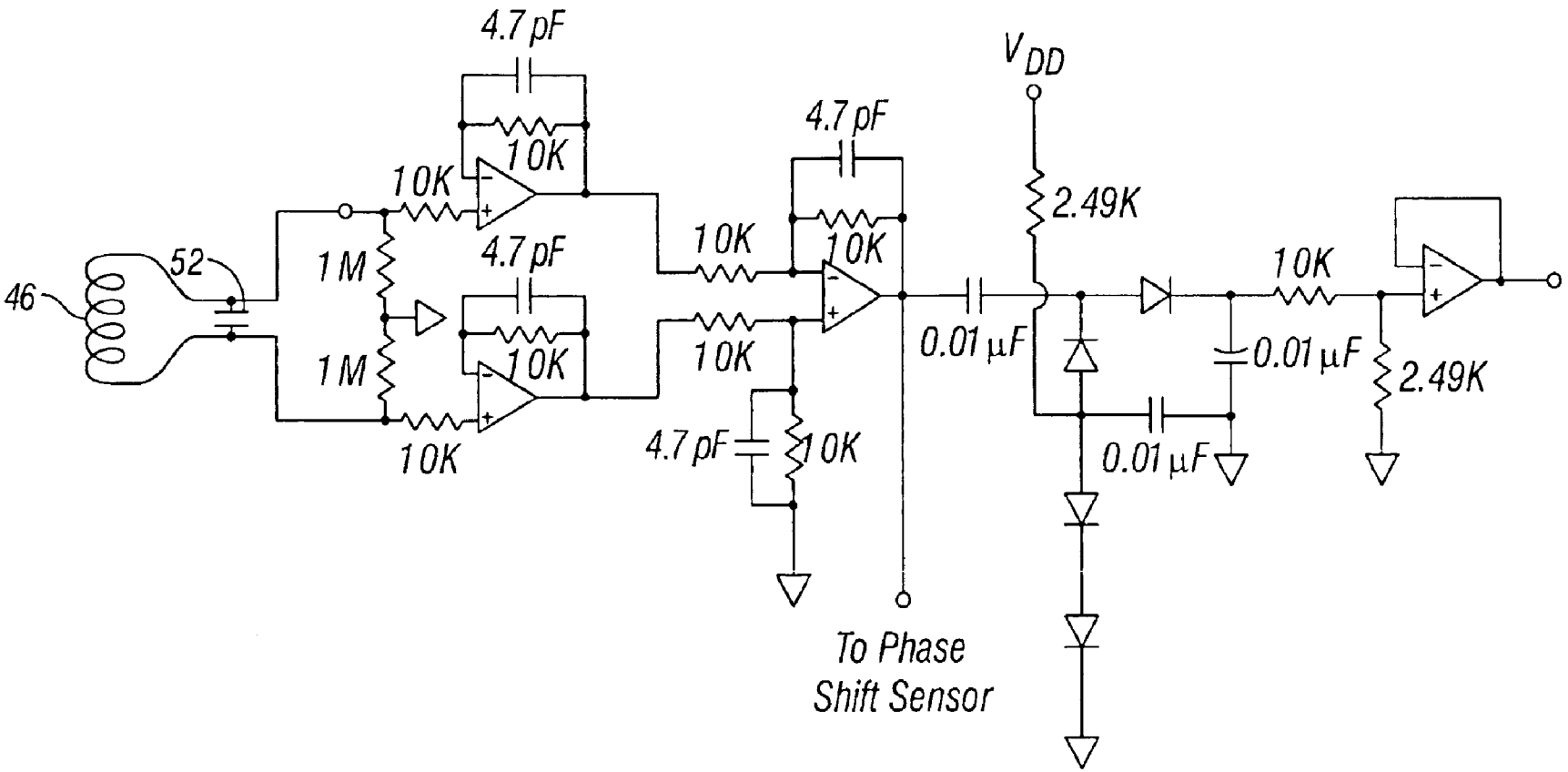
Figure 11:
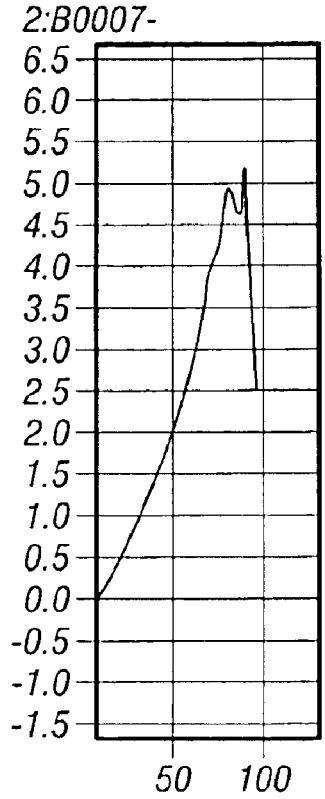
FIG. 11 is a graph illustrating a trace from the eddy current monitoring system that measures phase shift.

The phase shift measurement can be used to detect the polishing endpoint in the same fashion as the amplitude measurements discussed above. Alternatively, both amplitude and phase shift measurements could be used in the endpoint detection algorithm. An implementation for both the amplitude and phase shift portions of the eddy current monitoring system is shown in FIG. 10A. An implementation of the amplitude sensing portion of the eddy current monitoring system is shown in FIG. 10B. An example of a trace generated by an eddy current monitoring system that measures the phase difference between the drive and sense signals is shown in FIG. 11. Since the phase measurements are highly sensitive to the stability of the driving frequency, phase locked loop electronics may be added.

A possible advantage of the phase difference measurement is that the dependence of the phase difference on the metal layer thickness may be more linear than that of the amplitude. In addition, the absolute thickness of the metal layer may be determined over a wide range of possible thicknesses. A phase difference measurement may additionally be less sensitive to changes in pad thickness than an amplitude measurement.

The eddy current monitoring system can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. The polishing pad can be a standard (e.g., polyurethane with or without fillers) rough pad, a soft pad, or a fixed-abrasive pad. Rather than tuning when the substrate is absent, the drive frequency of the oscillator can be tuned to a resonant frequency with a polished or unpolished substrate present (with or without the carrier head), or to some other reference.

Various aspects of the invention, such as placement of the coil on a side of the polishing surface opposite the substrate or the measurement of a phase difference, still apply if the eddy current sensor uses a single coil. In a single coil system, both the oscillator and the sense capacitor (and other sensor circuitry) are connected to the same coil.

In an implementation of a semiconductor processing apparatus, an in-situ eddy current monitoring system such as system 40 of FIGS. 2A and 3 may be used to monitor the thickness of a conductive layer and/or to detect an endpoint or other point in a semiconductor process. The monitoring system may include a sensing system such as sensing system 58 to detect eddy currents induced in a conductive layer, using a drive system such as drive system 48. In some implementations, a core for a sensing system may be positioned in a recess in a platen.

In order to obtain information about properties of a conductive layer on a substrate, a time-dependent magnetic field may be produced using the drive system of the eddy current monitoring system. As explained above, a conductive layer acts as an impedance source and reduces the received signal. In order to provide an accurate measure of the thickness of a conductive layer (or accurate endpoint determination), the magnetic field needs to have sufficient magnitude at the conductive layer so that it can have a measurable effect on the received signal. For conductive layers with higher resistivities (e.g., tungsten layers rather than copper layers), the magnetic field may need to have a greater amplitude, since the magnitude of produced eddy currents is smaller.

However, in order to provide a sufficient magnetic field in the conductive region of interest, the magnetic field may have a non-negligible amplitude in conductive and/or magnetic regions of the semiconductor processing apparatus other than the conductive regions of interest. In such cases, inaccuracies may be introduced into the received signal.

Figure 12:
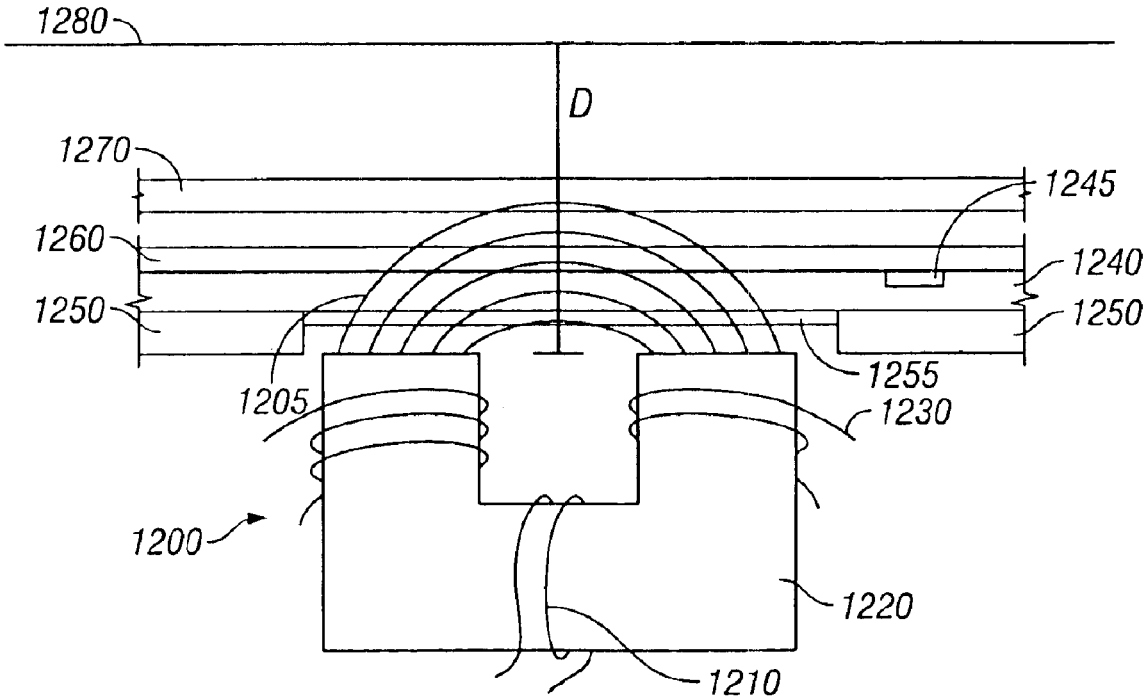
FIG. 12 is a cross-sectional view of a simplified representation of an electromagnetic field distribution relative to an eddy current sensor system and a substrate in a chemical mechanical polishing apparatus.

Referring to FIG. 12, an eddy current monitoring sensor assembly 1200 produces a varying magnetic field 1205 in order generate eddy currents in one or more conductive regions 1245 on a substrate 1240, in order to monitor the thickness of the conductive regions 1245. Assembly 1200 includes a drive coil 1210 and a sense coil 1230 around a core 1220 for producing field 1205. The profile of magnetic field 1205 is generally determined by the geometry of eddy current sensor assembly 1200; for example, core shape, orientation of windings, shielding, and presence of conductive or magnetic material proximate to the sensor. The maximum value of the time-dependent current in coil 1210 may be selected based on factors such as the resistivity of the material of conductive regions 1245. For example, in order to monitor the thickness of a relatively resistive conductive region 1245 (e.g., tungsten rather than copper), the eddy current monitoring sensor assembly 1200 may provide more current to coil 1210 to produce a time-varying magnetic field of greater maximum magnitude. Depending on the details of assembly 1200, the magnetic field may have a non-negligible magnitude beyond conductive region 1245.

During polishing, substrate 1240 is held against a polishing pad 1250 having a thin portion 1255 by a flexible membrane 1260. A plate 1270 proximate to the flexible membrane may be included in a carrier head assembly (e.g., plate 1410 of carrier head 1400 FIG. 14 or carrier body 1526 of carrier head 1500 of FIG. 15). FIG. 12 illustrates an implementation where the magnetic field generated by coil 1210 has a non-negligible magnitude at plate 1270. If plate 1270 is fabricated using a conductive and/or magnetic material such as a metal, plate 1270 will generate eddy currents, which may affect the signal received at sense coil 1230, reducing the accuracy of the thickness or end point measurement being made. Therefore, fabricating plate 1270 from a non-conductive, non-magnetic material such as plastic or ceramic may improve the accuracy of the eddy current monitoring system.

For a particular chemical mechanical polishing system using an eddy current monitoring sensor assembly 1200, a sensing distance D may be defined between, for example, a surface of core 1220 and a plane 1280, where portions of the chemical mechanical polishing system at a distance of D or less from the surface of core 1220 are non-conductive, in order to improve the sensing ability of the eddy current monitoring system.

The sensing distance D may correspond to a distance at which the eddy current signal generated in conductive parts of the chemical mechanical polishing system rather than in conductive regions on the substrate is not discernible over other noise in the signal. Alternately, D may be chosen as a distance at which the eddy current signal generated in conductive parts of the system is small enough that the accuracy of the thickness or endpoint measurement being made falls within acceptable limits. For example, an error amount may be defined for a measurement of an eddy current signal. D may be chosen as a distance beyond which the eddy current signal generated in conductive parts of the system is less than or equal to the error amount. D may be chosen in some other way; for example, as a distance at which the magnetic field falls to a certain percentage of the maximum value.

D may depend on a number of factors, including the types of conductive materials to be polished, the geometry of the eddy current monitoring system, and the acceptable contribution to the sensed signals from sources other than the conductive regions on the layer. For magnetic fields more localized in the substrate region, a smaller sensing distance may suffice; for example, the signal accuracy may be acceptable when parts of the carrier head within about a tenth of an inch of the substrate are non-conductive. For magnetic fields having an appreciable magnitude beyond the substrate, a larger sensing distance such as a sensing distance between about one inches and about two inches or even greater may be necessary to achieve a desired signal accuracy.

Figure 13:
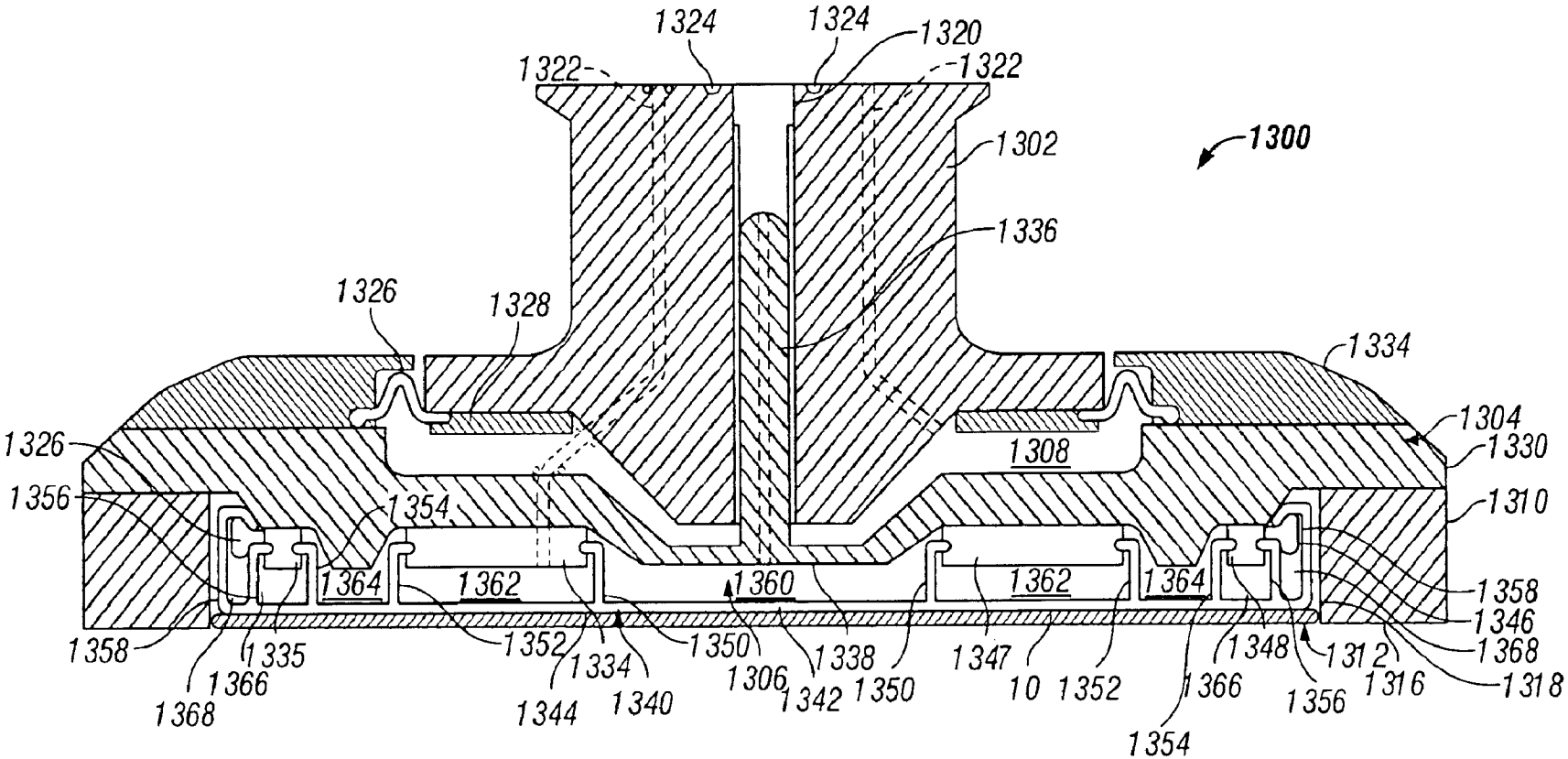
FIG. 13 is a cross-sectional view of a carrier head for a chemical mechanical polishing apparatus.

Determining which elements of a chemical mechanical polishing system should be non-conductive/non-magnetic depends on the system being used. Different implementations of carrier heads may have different elements that may potentially reduce the accuracy of the eddy current sensing system. Referring to FIG. 13, a carrier head 1300 that may be used in a CMP apparatus such as apparatus 20 of FIG. 1 includes a housing 1302, a base assembly 1304, a gimbal mechanism 1306 (which may be considered part of the base assembly), a loading chamber 1308, a retaining ring 1310, and a substrate backing assembly 1312 which includes five pressurizable chambers. A description of a similar carrier head may be found in U.S. patent application Ser. No. 09/712,389, "Multi-Chamber Carrier Head with a Flexible Membrane," filed Nov. 13, 2000, which is hereby incorporated by reference.

The housing 1302 can be generally circular in shape and can be connected to the drive shaft 74 of FIG. 1 to rotate therewith during polishing. A vertical bore 1320 may be formed through the housing 1302, and five additional passages 1322 (only two passages are illustrated) may extend through the housing 1302 for pneumatic control of the carrier head. O-rings 1324 may be used to form fluid-tight seals between the passages through the housing and passages through the drive shaft.

The base assembly 1304 is a vertically movable assembly located beneath the housing 1302. The base assembly 1304 includes a main base portion such as a generally rigid annular body 1330, an outer clamp ring 1334, and the gimbal mechanism 1306. The gimbal mechanism 1306 includes a gimbal rod 1336 which slides vertically the along bore 1320 to provide vertical motion of the base assembly 1304, and a flexure ring 1338 which bends to permit the base assembly to pivot with respect to the housing 1302 so that the retaining ring 1310 may remain substantially parallel with the surface of the polishing pad.

The loading chamber 1308 is located between the housing 1302 and the base assembly 1304 to apply a load, i.e., a downward pressure or weight, to the base assembly 1304. The vertical position of the base assembly 1304 relative to the polishing pad 32 of FIG. 1 is also controlled by the loading chamber 1308. An inner edge of a generally ring-shaped rolling diaphragm 1326 may be clamped to the housing 1302 by an inner clamp ring 1328. An outer edge of the rolling diaphragm 1326 may be clamped to the base assembly 1304 by the outer clamp ring 1334.

The retaining ring 1310 may be a generally annular ring secured at the outer edge of the base assembly 1304. When fluid is pumped into the loading chamber 1308 and the base assembly 1304 is pushed downwardly, the retaining ring 1310 is also pushed downwardly to apply a load to the polishing pad 32 of FIG. 1. A bottom surface 1316 of the retaining ring 1310 may be substantially flat, or it may have a plurality of channels to facilitate transport of slurry from outside the retaining ring to the substrate. An inner surface 1318 of the retaining ring 1310 engages the substrate to prevent it from escaping from beneath the carrier head.

The substrate backing assembly 1312 includes a flexible membrane 1340 with a generally flat main portion 1342 and five concentric annular flaps 1350, 1352, 1354, 1356, and 1358 extending from the main portion 1342. The edge of the outermost flap 1358 is clamped between the base assembly 1304 and a first clamp ring 1346. Two other flaps 1350, 1352 are clamped to the base assembly 1304 by a second clamp ring 1347, and the remaining two flaps 1354 and 1356 are clamped to the base assembly 1304 by a third clamp ring 1348. A lower surface 1344 of the main portion 1342 provides a mounting surface for the substrate 10.

The volume between the base assembly 1304 and the internal membrane 1350 that is sealed by the first flap 1350 provides a first circular pressurizable chamber 1360. The volume between the base assembly 1304 and the internal membrane 1350 that is sealed between the first flap 1350 and the second flap 1352 provides a second pressurizable annular chamber 1362 surrounding the first chamber 1360. Similarly, the volume between the second flap 1352 and the third flap 1354 provides a third pressurizable chamber 1364, the volume between the third flap 1354 and the fourth flap 1356 provides a fourth pressurizable chamber 1366, and the volume between the fourth flap 1356 and the fifth flap 1358 provides a fifth pressurizable chamber 1368. As illustrated, the outermost chamber 1368 is the narrowest chamber. In fact, the chambers 1352, 1354, 1356 and 1358 can be configured to be successively narrower.

Each chamber can be fluidly coupled by passages through the base assembly 1304 and housing 1302 to an associated pressure source, such as a pump or pressure or vacuum line. One or more passages from the base assembly 1304 can be linked to passages in the housing by flexible tubing that extends inside the loading chamber 1308 or outside the carrier head. Thus, pressurization of each chamber, and the force applied by the associated segment of the main portion 1342 of the flexible membrane 1340 on the substrate, can be independently controlled. This permits different pressures to be applied to different radial regions of the substrate during polishing, thereby compensating for non-uniform polishing rates caused by other factors or for non-uniform thickness of the incoming substrate.

Depending on the design of the eddy current sensing system, one or more parts of a carrier head such as carrier head 1300 of FIG. 13 may contribute to the received signal, and therefore affect the accuracy of the reading. In order to prevent such effects, elements of the chemical mechanical polishing apparatus which may produce eddy currents in response to the drive signal of the eddy current sensing system may be non-conductive and non-magnetic (i.e., have a high resistivity and a low magnetic permeability).

Conductive/magnetic elements of carrier head 1300 in higher field regions may provide a greater contribution to the received signal. Those elements that are less resistive (e.g., fabricated from a material with a lower resistivity and/or having a shorter length/smaller cross sectional area for current flow) may provide a greater contribution to the received signal, as may those elements having a greater magnetic permeability. Therefore, elements of carrier head 1300 that are closer to substrate 10 and/or are larger may be fabricated from a non-conductive material to improve the ability of the eddy current sensing system to reflect changes in one or more conductive regions on a substrate.

In some implementations, the eddy current signal may be sufficiently improved by fabricating elements of carrier 1300 using semiconductive materials such as silicon or semiconductive ceramics. Additionally, in some implementations replacing conductive, magnetic parts with conductive non-magnetic parts may provide a significant signal improvement. For example, some stainless steel parts made from an alloy with a non-negligible magnetic permeability may be replaced by aluminum parts. Although the resistivity of aluminum is lower than stainless steel, aluminum is non-magnetic and generally has a less detrimental effect on the measured signal.

In FIG. 13, some or all of the elements comprising base assembly 1304 may be non-conductive. Some or all of gimbal mechanism 1306 may be non-conductive. Additionally, some or all of housing 1302 may be non-conductive. Some or all fasteners (e.g., bolts) for assembling carrier 1300 (not shown in FIG. 13), such as the fasteners that secure the retaining ring 1310 to the base 1304, as well as supports for membrane 1340 may be non-conductive.

Providing non-conductive/non-magnetic fasteners may eliminate irregular noise termed "screw bump" noise. A particular fastener may contribute to the sensed signal in scans where the sensor scans under the screw, but not in other scans. Whether or not a particular fastener contributes to the signal depends on the geometry of the system, the rotational speed of the platen/head, and the head sweep. A screw bump is particularly problematic, because it may be confused with a signal caused by a locally thicker copper layer.

For a particular implementation of a chemical mechanical polishing system with an eddy current monitoring system, a minimum distance such as the sensing distance D discussed above may be determined, where unshielded conductive elements within the minimum distance of the eddy current monitoring system will detrimentally contribute to the eddy current signal. Although D was defined in terms of a distance from a surface of the sensing core, the minimum distance could alternately be stated in terms of the distance from the bottom of the flexible membrane (which is about equal to the distance from a conductive region on the wafer during polishing of the conductive region).

As mentioned above, some carrier head assemblies include a plate or ring behind a flexible membrane that holds a substrate to the polishing pad, where the plate may be perforated. The plate is generally close to the substrate during processing (e.g., in some implementations it is right behind the flexible membrane; in others, within about one or two inches of the substrate). If the plate is fabricated from a conductive material, it may be a source of inaccuracy in the sensed eddy current signal. Therefore, fabricating such a plate from a non-conductive material may allow for more accurate determination of the eddy current generated in the conductive regions on the substrate. Additionally, some carrier head assemblies include conductive fasteners, even for non-conductive parts of the carrier head. For example, retaining rings similar to retaining ring 1310 of FIG. 13 may be fabricated using a non-conductive material such as a hard plastic, for reasons unrelated to eddy current sensing. However, retaining rings are generally mounted to the carrier head using conductive fasteners (not shown). Providing a non-conductive fastener may improve the accuracy of the eddy current sensing system.

Figure 14:
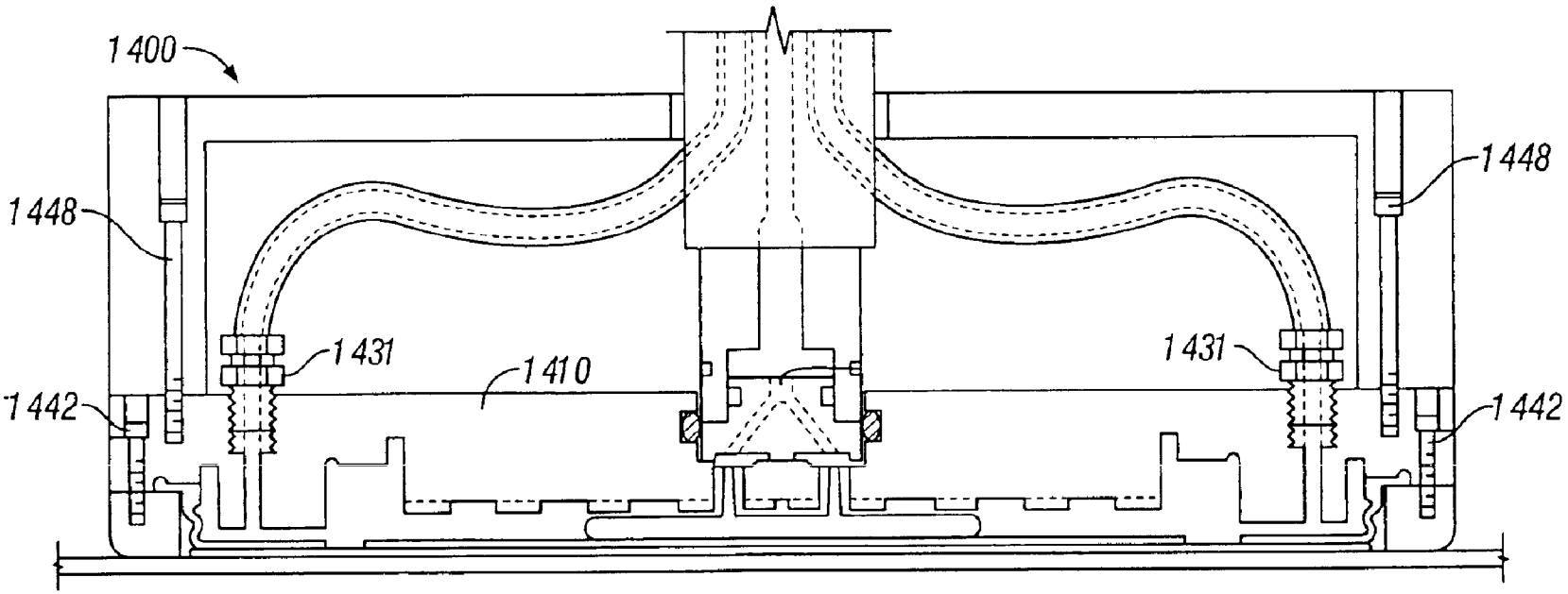
FIG. 14 is a cross-sectional view of another carrier head for a chemical mechanical polishing apparatus.

In other implementations of carrier heads, other elements may be proximate to a substrate being polished, and therefore (if conductive) may provide an unwanted contribution to a sensed signal for an eddy current monitoring system. Referring to FIG. 14, an implementation of a carrier head

1400 is shown. A description of a similar carrier head may be found in U.S. Pat. No. 6,056,632, filed Oct. 9, 1998, issued May 2, 2000, which is hereby incorporated by reference. Carrier head 1400 includes a carrier plate 1410 proximate to a substrate being polished. Carrier head 1400 also includes fasteners such as fastener 1442, conduit fasteners 1431, and fasteners 1448 that are proximate to a substrate being polished. Conductive plates and fasteners may affect the ability of a eddy current sensing system to accurately reflect changes in a conductive layer on a wafer. Carrier plate 1410, which is both close to the wafer and of a shape and size to produce significant eddy currents under the influence of a changing magnetic field, may be fabricated using a non-conductive material for improved eddy current sensing. Further, fasteners 1442, 1431, and 1448 may contribute to the eddy current signal if they are conductive. Signal improvement may be obtained by fabricating fasteners 1442, 1431, and 1448 using a non-conductive material.

Figure 15:
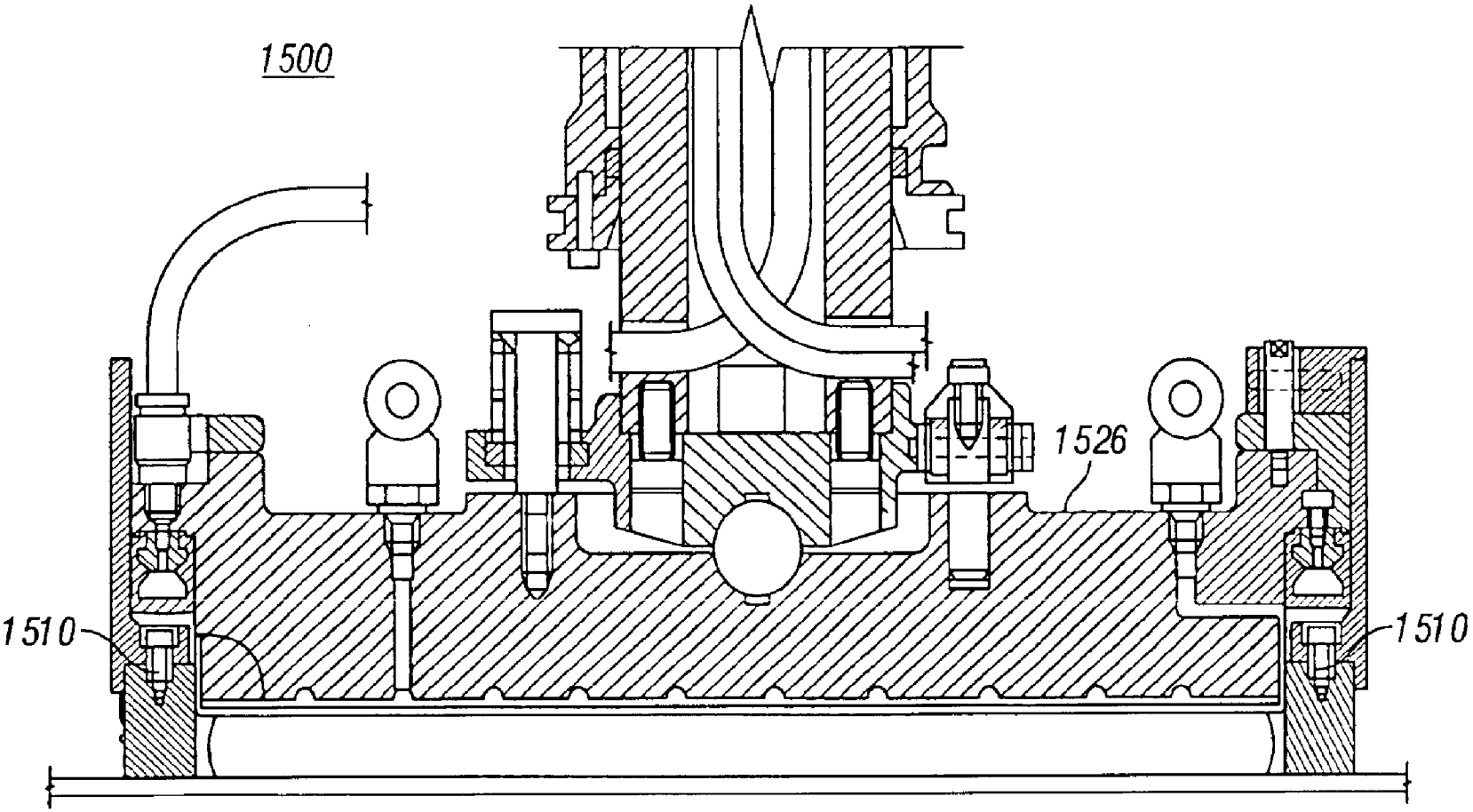
FIG. 15 is a cross-sectional view of another carrier head for a chemical mechanical polishing apparatus.

Referring to FIG. 15, a carrier head 1500 includes a carrier body 1526 proximate to a substrate being polished. A similar carrier head is described in U.S. Pat. No. 6,443,820, which is hereby incorporated by reference. Like carrier plate 1410 of FIG. 14, carrier body 1526 is both close to the wafer and of a shape and size to produce significant eddy currents under the influence of a changing magnetic field. Carrier head 1500 also includes a number of fasteners such as fasteners 1510 which may affect eddy current sensing if they are conductive and/or magnetic.

Figure 16:
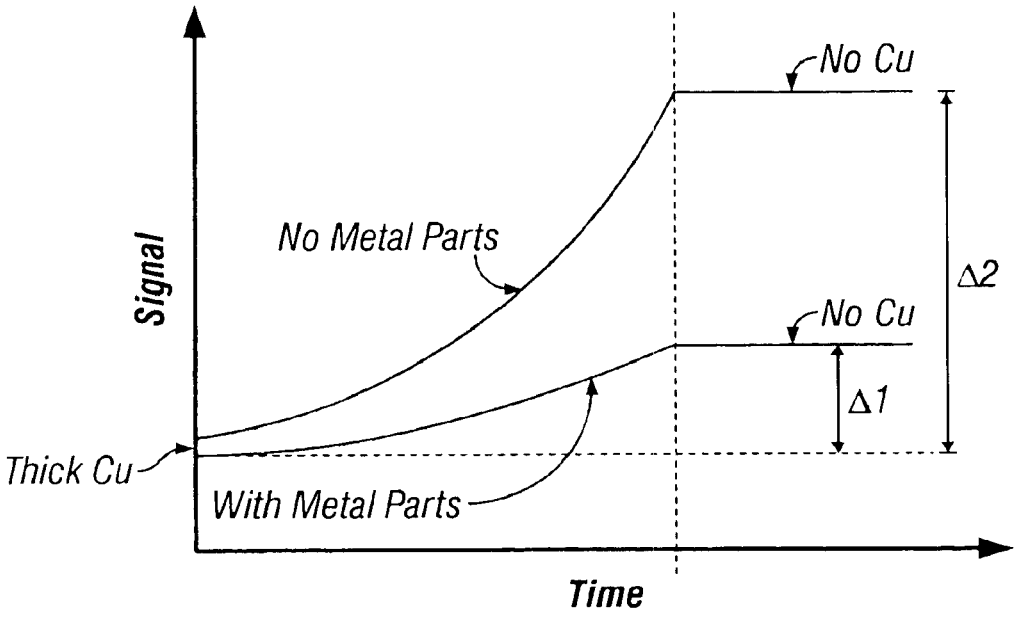
FIG. 16 is a plot of eddy current signal versus time for two implementations of a chemical mechanical polishing system.

FIG. 16 shows a plot of eddy current signal versus time as two different versions of a chemical mechanical polishing system remove a thick copper layer from a wafer. The first version includes a head with metal parts with a non-negligible magnetic permeability, while the second version includes a head with non-conductive, non-magnetic parts. Non-conductive/non-magnetic materials that may be used include plastics such as teflon and peek, aluminum (which may be electropolished and/or anodized), and non-magnetic steel. Many other materials may be used.

The difference in the sensed signal for the second version, denoted as $\Delta 2$, is much larger than the signal difference for the first version, denoted as $\Delta 1$. The metal parts, which are both conductive and magnetic, introduce a large background in the measured signal. Thus, the sensitivity of the eddy current sensing system in the first version is significantly less than the sensitivity in the second version.

A number of implementations have been described. Nevertheless, it will be understood that various modifications may be made without departing from the spirit and scope of the invention. For example, different implementations of carrier heads and eddy current sensing systems may be used. Fabricating elements of the carrier head or other part of the chemical mechanical polishing apparatus from non-conductive materials such as plastics or ceramics may improve the accuracy of the eddy current sensing system. Accordingly, other embodiments are within the scope of the following claims.

What is claimed is:

1. A polishing system, comprising:

a polishing pad support to hold a polishing pad having a polishing surface;

a carrier to hold a substrate against the polishing surface of the polishing pad; and an eddy current monitoring system including an induction coil, the eddy current monitoring system positioned to generate a magnetic field through the pad into a sensing region of the system current polishing, wherein each component of the carrier with at least a portion positioned during polishing within a sensing distance of the polishing surface in the sensing region is nonconductive, and wherein, in response to generating the magnetic field, the eddy current monitoring system is to receive an eddy current signal from one or more conductive regions on the substrate, and a noise signal during polishing, and wherein the sensing distance is a distance beyond which an eddy current signal from one or more conductive components of the carrier is not discernible over the noise signal.

2. A polishing system, comprising:

a polishing pad support to hold a polishing pad having a polishing surface;

a carrier to hold a substrate against the polishing surface of the polishing pad; and an eddy current monitoring system including an induction coil positioned to generate a magnetic field through the polishing pad into a sensing region of the system, wherein each component of the carrier with at least a portion positioned during polishing within a sensing distance of the polishing surface in the sensing region is nonconductive, and wherein, in response to generating the magnetic field, the eddy current monitoring system is to receive an eddy current signal from one or more conductive regions on the substrate and an eddy current signal from one or more conductive components of the carrier during polishing, and wherein the sensing distance is a distance beyond which the eddy current signal from the one or more conductive components of the carrier is about equal to or less than an error amount corresponding to an acceptable amount of signal inaccuracy.

3. The system of claim 1, wherein the sensing distance is between about one tenth of an inch and about two inches.

4. The system of claim 3, wherein the sensing distance is between about one inch and about two inches.

5. The system of claim 1, wherein the each component of the carrier with at least a portion positioned during polishing within a sensing distance of the polishing surface in the sensing region comprises one or more fasteners.

6. The system of claim 1, wherein the each component of the carrier with at least a portion positioned during polishing within a sensing distance of the polishing surface in the sensing region comprises one or more components of a substrate backing assembly.

7. The system of claim 6, wherein the one or more components of a substrate backing assembly include at least one of a ring and a plate.

8. The system of claim 6, wherein the one or more components of a substrate backing assembly comprises a flexible membrane and one or more substantially rigid components.

9. The system of claim 1, wherein each component of the carrier is non-conductive.

10. The system of claim 2, wherein the sensing distance is between about one tenth of an inch and about one inch.

11. The system of claim 2, wherein the sensing distance is between about one inch and about two inches.

12. The system of claim 2, wherein the each component of the carrier with at least a portion positioned during polishing within a sensing distance of the polishing surface in the sensing region comprises one or more fasteners.

13. The system of claim 2, wherein the each component of the carrier with at least a portion positioned during polishing within a sensing distance of the polishing surface in the sensing region comprises one or more components of a substrate backing assembly.

14. The system of claim 13, wherein the one or more components of a substrate backing assembly include at least one of a ring and a plate.

15. The system of claim 13, wherein the one or more components of a substrate backing assembly comprises a flexible membrane and one or more substantially rigid components.

16. The system of claim 2, wherein each component of the carrier is non-conductive.

* * * * *